US006129963A

United States Patent [19]

Lesko et al.

[11] Patent Number: 6,129,963

[45] Date of Patent: Oct. 10, 2000

[54] EASY LAMINATED SIGN MANUFACTURE

[75] Inventors: Robert J. Lesko, Andover; Shannon K. Lesko, Hackettstown, both of N.J.

[73] Assignee: HID Systems, Inc., Sparta, N.J.

[21] Appl. No.: 08/709,579

[22] Filed: Sep. 9, 1996

[51] Int. Cl.[7] ..... B42D 15/00; G03G 8/00

[52] U.S. Cl. ..... 428/40.1; 283/81; 428/40.2; 428/41.3; 428/41.6; 428/41.7; 428/41.8; 428/41.9; 428/42.1; 428/201; 428/204; 428/480; 428/481

[58] Field of Search ..... 428/40.1, 41.3, 428/41.6, 41.7, 41.8, 41.9, 42.1, 201, 204, 480, 481, 40.2; 283/81

[56] References Cited

U.S. PATENT DOCUMENTS

| | | | |
|---|---|---|---|
| 3,001,886 | 9/1961 | Shrewsbury | 428/202 |
| 3,488,189 | 1/1970 | Mayer | 430/67 |
| 3,494,818 | 2/1970 | Marchese | 428/202 |
| 3,854,229 | 12/1974 | Morgan | 40/2 |
| 4,184,701 | 1/1980 | Franklin et al. | 283/9 |
| 4,526,847 | 7/1985 | Walker | 428/481 |
| 4,763,930 | 8/1988 | Matney | 283/81 |
| 5,126,797 | 6/1992 | Forest | 355/278 |
| 5,135,261 | 8/1992 | Cusack | 40/641 |
| 5,300,160 | 4/1994 | Wilson et al. | 156/64 |
| 5,320,387 | 6/1994 | Carlson | 283/75 |
| 5,380,572 | 1/1995 | Kotani et al. | 428/40 |
| 5,407,718 | 4/1995 | Popat et al. | 428/42 |
| 5,518,787 | 5/1996 | Konkol | 428/43 |

OTHER PUBLICATIONS

3M Brand Exposure Unit Brochure "Scotchcal" Photosensitive Markings Brochure, 3M Company.

Scotchcal Photosensitive Brochure, 3M Company Dynamark Brochure, 3M Company.

Processing Instructions for 3M Photosensitive Label Series 8000, 3M Company.

Properties, Processing and Application of 3M Brand Photosensitive Label, 3M Company.

*Primary Examiner*—Nasser Ahmad

*Attorney, Agent, or Firm*—Rhodes & Mason, PLLC

[57] ABSTRACT

The present invention relates to a laminated article and a method for making the article. An imageable film is printed on a first side with an image created in a computer. The image can be black and white or color. The imageable film can be transparent or white. The image containing film is then overlaid with a transparent laminate layer to protect the image from weather, abrasion and wear. A colored substrate may be applied on a second side of the imageable film to create a colored sign. The colored substrate may also be used to introduce special effects to the appearance of the finished laminated article.

6 Claims, 1 Drawing Sheet

EASY LAMINATED SIGN MANUFACTURE

BACKGROUND OF THE INVENTION

The present invention relates generally to laminated articles and methods for making those articles. The invention is particularly adapted for making labels and signs for a wide variety of applications in a simple and cost-effective manner.

This invention relates to a construction and a method for creating a laminated article. The method is particularly adapted for creating labels, nameplates and signs and other articles as described hereinbelow. The articles so created are particularly adapted for use in situations where they will be exposed to weather, abrasion and wear.

Laminated signs and labels are known, but are made using technologies that are expensive, labor-intensive and involve the use of hazardous or foul-smelling chemicals. In particular, known techniques for making quality signs and labels use photographic techniques that require specialized equipment including specialized light sources and photosensitive films or plates. These items are expensive capital investments and hence are not available to many potential users needing to have labels or signs made.

A number of patents disclose constructions for laminated labels. These include U.S. Pat. No. 5,518,787 to Konkol; U.S. Pat. No. 5,407,718 to Popat, et al.; U.S. Pat. No. 5,320,387 to Carlson; U.S. Pat. No. 3,854,229 to Morgan; U.S. Pat. No. 4,763,930 to Matney; and U.S. Pat. No. 5,380,572 to Kotani, et al.

SUMMARY OF THE INVENTION

The present invention relates to a method for making a laminated article including: a) creating an image in a computer; b) printing the image onto a first side of an imageable film by a laser printer, the film having: i) an imageable layer having a first side and a second side; ii) an adhesive layer applied to the second side of the imageable layer; and iii) a release paper layer adhered to the adhesive layer; and c) overlaying the first side of the imageable layer with a transparent laminate layer. The imageable film may be a transparent film or a white opaque film. A preferred material for the imageable film is polyester.

An additional aspect of the present invention relates to removing the release paper layer and overlaying the adhesive layer of the imageable film with a colored substrate. A preferred material for this overlaying step is vinyl. The invention also comprehends providing the colored substrate in a variety of finishes to include a reflective finish and a luminescent finish.

Another aspect of the present invention includes providing a kit containing the components required to practice the present invention. Such a kit includes an imageable film having: i) an imageable layer having a first side and a second side; ii) an adhesive layer applied to the second side of the imageable layer; and iii) a release paper layer adhered to the adhesive layer; a transparent laminate film for overlaying the first side of the first side of the imageable film, a tool for removing air trapped between the imageable film and the laminate film, a wetting agent applied between the imageable film and the laminate film, and iv) a cutting tool for trimming the imageable film and the laminate film to a desired size.

BRIEF DESCRIPTION OF THE DRAWINGS

The invention will be better understood from the following more detailed description and appended claims. The accompanying drawings, which are incorporated and constitute a part of the specification, illustrate one embodiment of the invention and, together with the description, serve to explain the principles of the invention.

DESCRIPTION OF THE PREFERRED EMBODIMENTS

Figure 1:
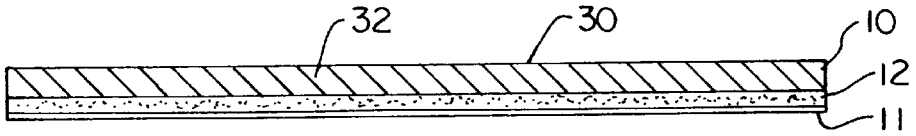
FIG. 1 is a sectional view of the imageable film of the present invention.

Reference will now be made in detail to a present-preferred embodiment of the invention, an example of which is illustrated in the accompanying drawings. Referring to FIG. 1, there is shown the imageable film 30. The imageable film 30 is has of an imageable layer 10 having a first side 32 and a second side with an adhesive layer 12 applied to the second side thereof. A paper-release layer 11 is adhered to the adhesive layer.

The imageable film 30 may be constructed of either a transparent film or a white film. If the film is white, preferably it is provided with a permanent adhesive 12. If the film is transparent, it may be provided with either a permanent adhesive or a temporary adhesive. Also, if the film is transparent, it may be desirable to use a colored or tinted adhesive. The white film is preferred for providing a black image on a white background or a white image on a black background as desired. The transparent film can be used alone or can be adhered to a colored substrate or to any other smooth material which will allow the color of the substrate to show through the transparent imageable film. Suitable materials for the colored substrate include polyester, vinyl and polycarbonate. Practice of the present invention includes the use of any suitable imageable film. The preferred material for the imageable film, whether it be white or transparent, is polyester. Polyester is preferred for its thermal stability and absorption characteristics.

Figure 2:
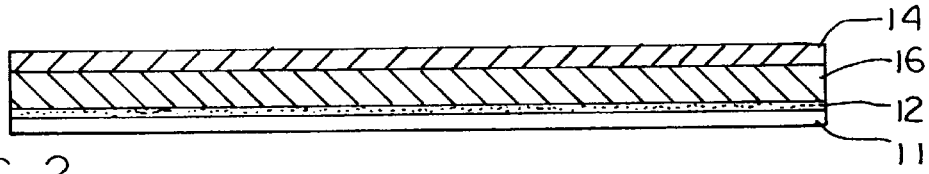
FIG. 2 is a sectional view of the imageable film of the present invention with an image applied thereto.

The next step in creating the laminated article of the present invention is illustrated in FIG. 2 where it can be seen that an image 14 has been printed onto the first side of the imageable film 10. The image can be created in a computer using one of the readily available, well-known software programs. Although the image 14 in FIG. 2 is shown as being completely co-extensive with the imageable layer 10, it should be understood that in many cases the image will occupy less than the total surface of the imageable layer.

Preferably, the image 14 is printed onto the first side of the imageable film by a laser printer. A laser printer makes its images by depositing toner particles on the film 10 and fusing them in place. The image may be created in color or in black-and-white as desired. As will be readily appreciated by one of ordinary skill, multiple images may be printed onto a single sheet of imageable film.

Figure 3:
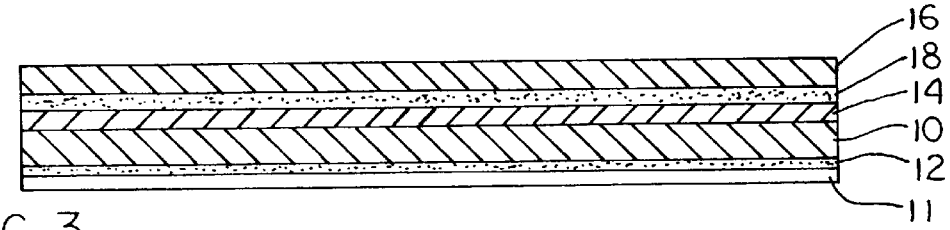
FIG. 3 is a cross-sectional view of the image-bearing film from FIG. 2 with a laminate applied thereto.

Turning now to FIG. 3, it can be seen that the first side of the imageable layer 10 has been overlaid with a transparent laminate layer 16. The laminate layer 16 is adhered to the imageable layer via the laminate adhesive 18. The laminate layer 16 may be provided with one of several different kinds of finish, depending on the intended use for the article and the type of look desired. A gloss finish may be used to create a slightly more reflective article and to achieve a bolder look. A matte finish may be used to provide a softer look. As can be seen, the visual effect of the finished product can be varied by varying the finish of the laminate film. The section of laminate film 16 selected to overlay the imageable film should be slightly larger than the imageable film 10 to avoid registration problems.

The laminated article shown in FIG. 3 is ready for use and may be applied to a given surface by removing the release paper layer 11 and applying the article to the desired surface. If a transparent film is used as the imageable film 10, the laminated article will take on the color of the surface to which it is applied. For some applications, this transparency can be problematical. For instance, if the laminated article is a label or a sign intended to overlay and cover another sign, the text of the old sign will show through the newly applied label. There may also be a requirement for a label to stand out and be easily discernable from the surface to which it is applied. Examples include directional signs, emergency exit signs, or signs that warn of dangerous conditions.

Figure 4:
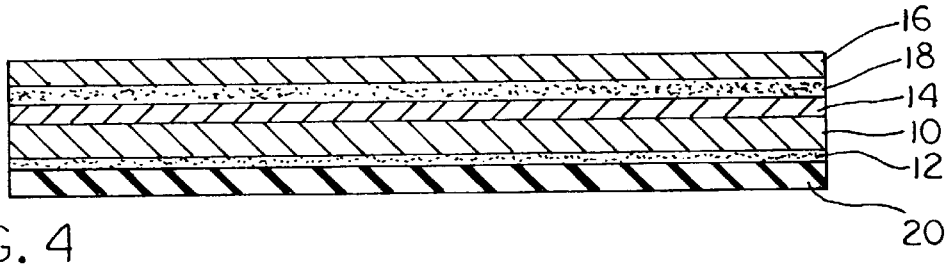
FIG. 4 depicts an alternative embodiment of the present invention having a colored substrate applied to the adhesive-bearing side of the imageable film.

To address these applications, a colored substrate 20 may be applied to the second side of the imageable film as illustrated in FIG. 4. Again, the release paper layer 11 is first removed from the imageable film adhesive layer 12 and the colored substrate 20 is applied thereto. The colored substrate 20 may also be provided with its own adhesive layer and release paper layer (not shown) for installation. A label or sign thus constructed will take on the color of the colored substrate layer 20. Suitable materials for this purpose are available in a variety of colors and can include special treatments such as brushed aluminum, brushed gold, and reflective yellow or silver. The present invention also contemplates using a substrate having a luminescent finish for those situations where the contents of the label must be visible in darkness without light. Items having the desired luminescent properties are commonly referred to as having a "glow in the dark" capability. Preferably, the sheet stock used for the colored substrate 20 should be provided in a size that is slightly larger than that of the imageable film to avoid registration problems when adhering the colored substrate to the imageable film.

The method of making a laminated article according to the present invention is simple. First, an image, also referred to as artwork, is created in a computer using a graphic design program. The image is then printed onto the imageable film, preferably using a laser printer. The image can be printed on a white film, which is used when a black or a color image on a white background is desired. Alternatively, a transparent imageable film, having either a permanent or a removable adhesive layer, may be used. The removable adhesive removably adheres the layer to another layer. The transparent material may be used when a black image on a colored background is desired.

The imageable layer 10 is then overlaid with a transparent laminate layer 16. This step is carried out in a smooth, clean work surface on which the laminate layer 16 is placed face down, adhesive side up. It should be noted that the laminate layer 16 is supplied with its own release paper layer (not shown). After removing the laminate release paper layer, the laminate adhesive layer 18 is coated with a wetting agent. The wetting agent is preferably a detergent solution, which prevents the adhesive from prematurely adhering and permits some minor repositioning of the imageable film 10 on the laminate layer 16. The present invention includes the use of commonly available commercial wetting agents for this purpose. A preferred wetting agent is detergent available under the Joy™ brand. The Joy wetting agent is preferred because it is not an enzyme detergent which could attack the adhesive layer. It exhibits superior wetting capabilities and does not leave a residue after entrapped air removal. A solution made up of one cc Joy™ wetting agent and 16 ounces of distilled water has been found to provide optimum results. Distilled water is used because it is substantially free of impurities and bacteria.

The image-containing film 10 is positioned on the laminate layer 16 so that the image 14 on the first side 32 thereof is facing and in direct contact with the adhesive 18 of the laminate layer 16. These two pieces are then turned over on the work surface so that the laminate layer is on top. A resilient tool is then used to remove any trapped air located between the laminate layer and the imageable film. The preferred tool for this task is a squeegee. A suitable squeegee may be a corner softening tool used in screen printing and sold by Stretch Devices of Philadelphia, Pa. Other devices that are suitable for forcing air out from between the layers may be used. The air is forced from between the two layers using heavy, overlapping strokes with the squeegee, starting at the center of the film and working towards the edges. The film is then dried.

If a colored substrate is to be applied to the now completed laminated article, the article is turned over on the work plane so that the imageable film's release paper layer 11 is facing upwards. The release paper layer is then removed and the Joy™ solution is applied to the then-exposed adhesive layer. The colored substrate 20 is then carefully applied to the adhesive layer. The entire article, now consisting of three layers of materials, may be turned over so that any trapped air can be removed as described hereinabove. Next, the laminated article is placed on a cutting mat. The preferred material for the cutting mat is one having self-healing properties so that the score lines created by a knife blade penetrating the mat will reseal themselves. The laminated article is then trimmed to size using a suitable cutting tool guided by a straight edge. Fixed-blade, snap-off knives, or rotary knives may be used for this purpose.

In order to maximize the effectiveness of this method, it is desirable that the work plate on which the article is assembled have dielectric properties similar to those of glass and plexiglass. The films used in the practice of the present invention will remain attracted to the work plate when the release paper layer is removed therefrom because of the high dielectric constant value of the work plate. Accordingly, the film will not move or fold over when the release paper layer is removed. Also, the material used for the tool for removing trapped air between layers should be selected so that it is firm enough to remove the air but should be soft enough so as not to scratch any of the layers of the laminated article.

Figure 5:
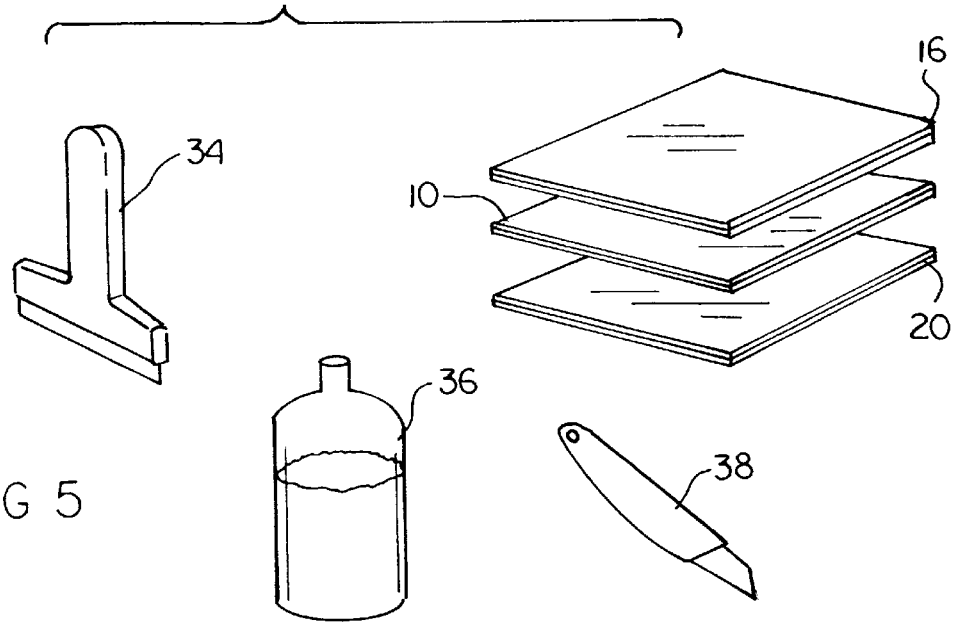
FIG. 5 shows the components of a kit that can be marketed to permit a user to make laminated articles according to an embodiment of the invention.

Although the present invention has been described so far by reference to its component parts, it is possible and preferable to provide those components in kit form, as seen in FIG. 5. Such a kit would provide the imageable film 10 as described herein above, the transparent-laminate film 30, a tool for removing air trapped between the imageable film and the laminate film 34, a wetting agent 36 applied between the imageable film and the laminate film; and a cutting tool 38 for trimming the imageable film and the laminate film to a desired size. Various types of cutting tools may be included, including a rotary knife, snap-off knife and a corner rounder. A stainless steel straight edge may also be included to advantage. A cutting mat, particularly a self-healing cutting mat at may be useful.

A workplate, such as of a material high in dielectric properties, similar to glass and plexiglass may also be included. The kit greatly facilitates the practice of the present invention. It may be embodied in any one of a number of commonly-available, easy-to-transport containers or cases.

The method disclosed herein provides a simple, fast method for creating signs and labels for a variety of applications. The method does not require photo-sensitive materials or chemical processing. The laminated articles made according to the present invention take full advantage of the myriad images that may be created using computer graphics programs and computer-assisted design and drafting programs. These images include logos, wiring diagrams, lubricating charts, electrical circuit diagrams, piping diagrams, and signs of all types. Other uses will be apparent to those of ordinary skill in the art.

Although the present invention has been described with preferred embodiments, it is to be understood that modifications and variations may be utilized without departing from the spirit and scope of this invention, as those skilled in the art will readily understand. Such modifications and variations are considered to be part of the invention, provided they come within the scope of the appended claims and their equivalents.

What is claimed is:

1. A laminated article comprising two layers:

a) a polyester film having a first side and a second side, said first side having an image formed of fused toner particles printed thereon; and a transparent laminate adhered to said first side of said polyester film so that said image is sandwiched between said transparent laminate and said first side.

2. A laminated article comprising:

a) a transparent, imageable polyester film having a first side and a second side, said first side having an image formed of fused toner particles printed thereon;

b) a transparent laminate adhered to said first side of said imageable film, and c) a colored substrate adhered to said second side of said imageable film.

3. A laminated article comprising two layers:

a) a transparent film having a first side and a second side, said first side having an image formed of fused toner particles printed thereon; and b) a transparent laminate adhered to said first side of said transparent film with an adhesive so that said image is sandwiched between said transparent laminate and said first side.

4. A laminated article comprising three layers:

a) a polyester film having a first side and a second side, said first side having an image formed of fused toner particles printed thereon; a transparent laminate adhered to said first side of said polyester film so that said image is sandwiched between said transparent laminate and said first side; and a colored substrate adhered to said second side of said polyester film.

5. The laminated article as claimed in claim 1 further comprising adhesive between said polyester film and said transparent laminate adhering said laminate to said polyester film.

6. The laminated article as claimed in claim 4 further comprising adhesive between said polyester film and said transparent laminate adhering said laminate to said polyester film.

* * * * *